United States Patent [19]

Tyson

[11] Patent Number: 4,747,494

[45] Date of Patent: May 31, 1988

[54] COLLECTOR'S STAND

[76] Inventor: Youree Tyson, P.O. Box 491, Eunice, La. 70535

[21] Appl. No.: 13,046

[22] Filed: Feb. 10, 1987

[51] Int. Cl.[4] ..... A47F 7/00

[52] U.S. Cl. ..... 211/13; 47/39; 211/71; 211/133; 248/163.1

[58] Field of Search ..... 248/163.1; 211/13, 133, 211/205, 189, 196, 71; 47/39, 66, 67, 41 R, 41.11

[56] References Cited

U.S. PATENT DOCUMENTS

| | | | |
|---|---|---|---|
| 88,739 | 4/1869 | Reichenbach | 211/196 X |
| 115,456 | 5/1871 | Fisher | 211/182 X |
| 883,162 | 3/1908 | Baecker | 248/163.1 X |
| 904,758 | 11/1908 | Cropp | 211/205 X |
| 1,401,057 | 12/1921 | Elliott . | |
| 1,715,603 | 6/1929 | Kamman | 248/163.1 X |
| 1,797,077 | 3/1931 | Dew et al. | 211/71 X |
| 1,897,905 | 2/1933 | Johnson | 248/163.1 X |
| 1,955,919 | 4/1934 | Kress . | |
| 2,504,902 | 4/1950 | Strople et al. . | |
| 2,673,053 | 3/1954 | Kilian . | |
| 2,679,996 | 6/1954 | Rowe et al. | 248/156 X |
| 2,689,050 | 9/1954 | Albin . | |
| 2,794,554 | 6/1957 | Donner | 211/71 |
| 3,160,380 | 12/1964 | Blades . | |
| 3,169,742 | 2/1965 | Smith | 248/156 X |
| 4,218,979 | 8/1980 | Esposito et al. . | |

*Primary Examiner*—Ramon O. Ramirez

*Attorney, Agent, or Firm*—Cushman, Darby & Cushman

[57] ABSTRACT

A stand for supporting a plurality of objects at a plurality of spaced vertical intervals comprising a plurality of object supports, a vertical support member on which the object supports are removably mounted and a support base member for supporting the vertical support member in an upright manner. A number of different types of object supports are provided to enable a number of different collector's stands to be formed in accordance with the needs of a particular collector.

8 Claims, 5 Drawing Sheets

Fig. 2
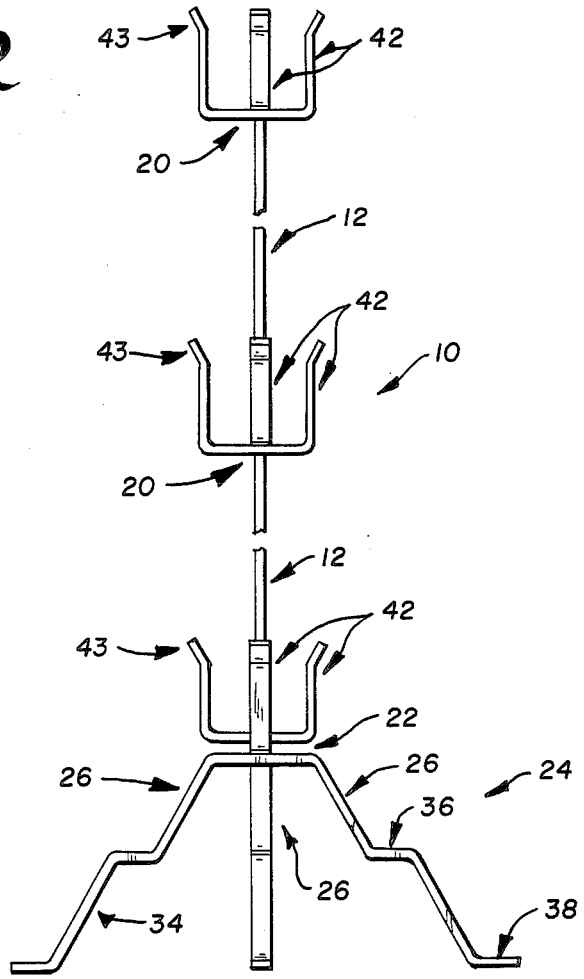
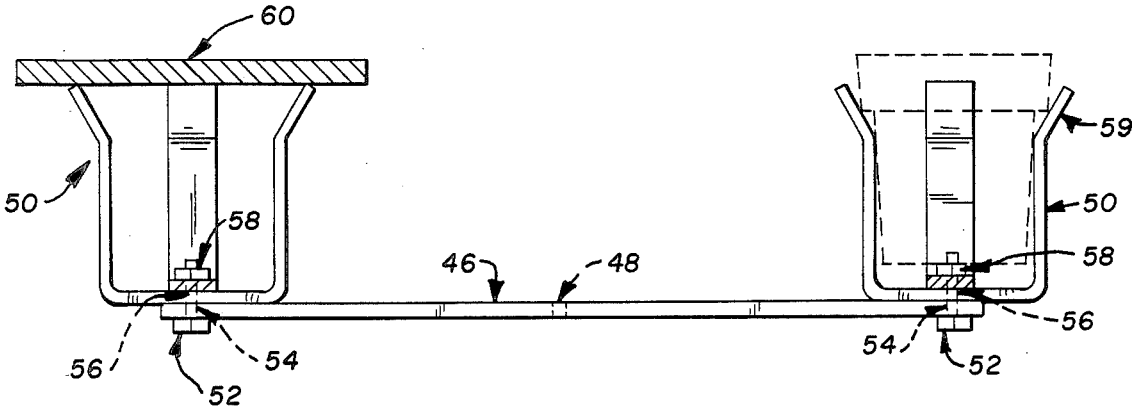
Fig. 3

Fig. 4
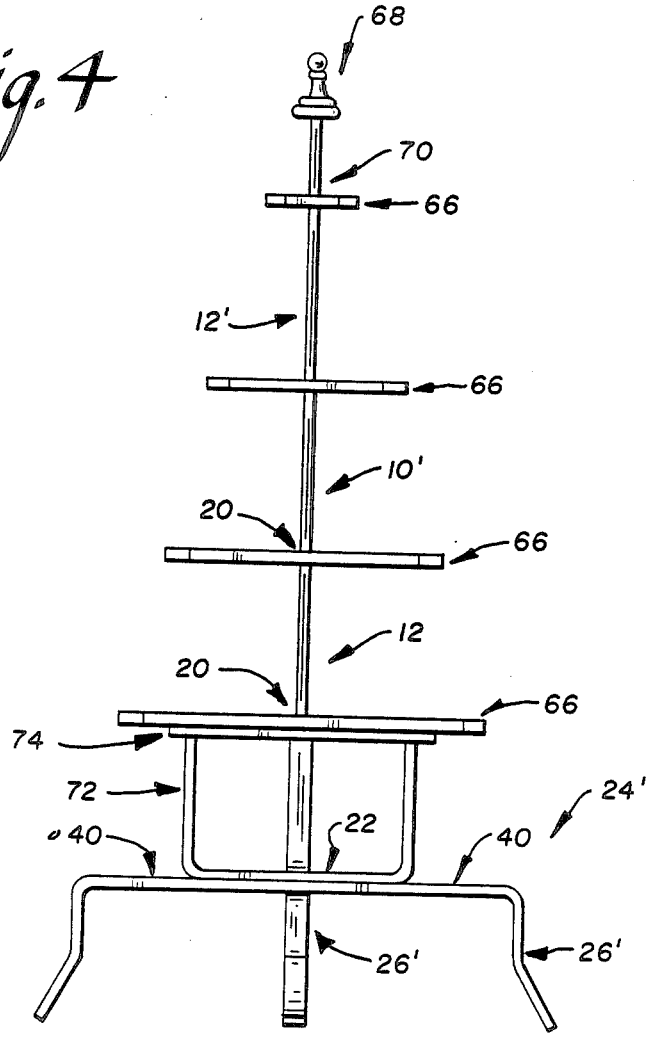
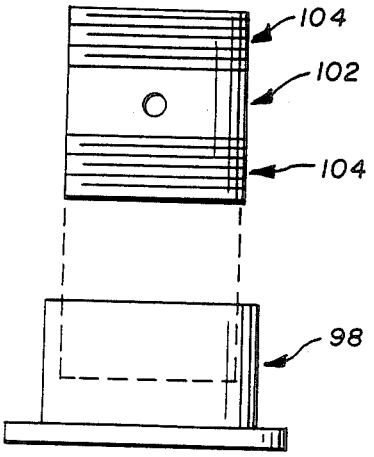
Fig. 7

COLLECTOR'S STAND

BACKGROUND OF THE INVENTION

1. Field of the Invention

The present invention relates to a stand for supporting a plurality of objects at a plurality of vertical levels and, more particularly, to a collector's table where a plurality of different, removably attached, support means are provided which may be interchanged to provide a structure that can support a variety of objects.

2. Description of the Prior Art

The prior art discloses stands or devices for supporting objects at vertically spaced levels such as shown in U.S. Pat. Nos. 115,456, 1,401,057, 1,955,919, 2,689,050, and 4,218,979. The prior art also discloses stands or devices for supporting objects in vertical orientation at a vertically spaced location as shown in U.S. Pat. Nos. 2,504,902, 2,673,053, 2,679,996, 3,160,380, and 3,169,742. However, the prior art does not disclose or suggest providing several different support means that may be interchanged so as to display a variety of objects, such as flower pots and collector's items, in a variety of different ways.

SUMMARY OF THE INVENTION

The present invention involves a stand for supporting a plurality of objects, such as flower pots and collector's items, at vertically spaced levels. The stand includes a vertical support structure and a support base structure. The support base structure is provided with a plurality of legs that extend outwardly and downwardly from the base of the vertical support structure. A plurality of support means are adapted to be secured along the support structure at vertically spaced intervals.

A variety of different support means may be attached at each of the vertically spaced intervals so as to support different numbers and types of objects. Similarly, the number of vertically spaced support means may be varied.

Accordingly, one object of the present invention is to provide a collector's stand that is capable of being readily assembled in each of several supporting arrangements so as to advantageously display different numbers and types of objects.

A further object of the present invention is the provision of a collector's stand that is capable of being partially or totally disassembled and reassembled with more or different support means as the collector desires and a stand that is both simple and inexpensive and yet capable of effectively providing the versatility described above.

Other objects, features, and characteristics of the present invention, as well as the functions of the related elements of the structure and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 2 is an elevational side view of an assembled collector stand in accordance with the present invention showing a possible combination of vertically spaced support means;

FIG. 3 is an elevational side view, partially in cross section, of one of the support means provided in accordance with the present invention;

FIG. 4 is an elevational side view of an alternative combination of vertically spaced support means;

FIG. 7 is an exploded view of the adaptor of FIG. 6.

DETAILED DESCRIPTION OF THE PREFERRED EXEMPLARY EMBODIMENTS

Figure 1:
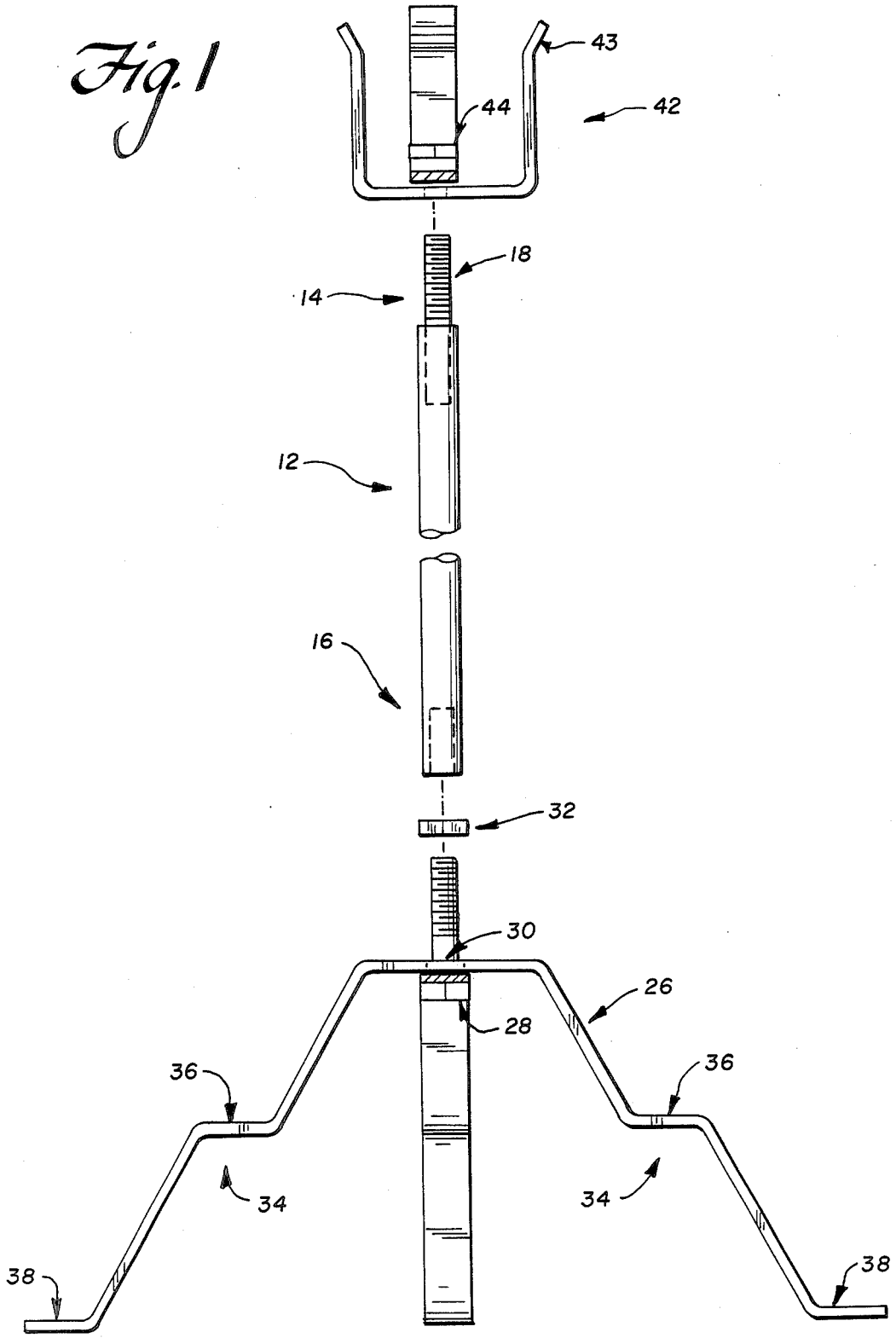
FIG. 1 is an exploded view partially in section of a portion of a collector's stand base and vertical support structure in accordance with the present invention.

Referring to the drawings in detail, FIGS. 1 and 2 show a first manner in which the collector's stand of the present invention may be assembled. As best seen in FIG. 2, vertical support structure 10 of the collector's stand comprises a series of collar members 12. Each of collar members 12 is provided with a male connection end 14 and a female connection end 16. Each of the male and female ends are provided with screw threads 18, for example, so that respective male and female ends of a given number of collar members 12 may be coupled together, as at 20, to form a vertical support structure 10 of a given length, as shown in FIG. 2. Couplings 20 provide the vertical intervals for the spaced support means of the collector's stand. Collar members 12 may be made of any suitable material including plastic but are preferably formed from metal, such as steel, and are approximately 16 inches in length.

A pair of cross legs 26 are provided at lowermost end 22 of vertical support structure 10. Cross legs 26 are adapted to be coupled to each other in an angled relationship midway along their length by a bolt 28 received through suitable apertures 30 and secured in place by a nut 32. The cross leg assembly so formed provides a horizontally disposed supporting base structure 24 for the vertical support structure 10. Cross legs 26 may then be coupled to vertical suppor structure 10 by threadingly attaching bolt 28 to female end 16 of lowermost collar member 12 of vertical support structure 10.

The end portions 34 of cross legs 26 extend outwardly and downwardly from lower end 22 of vertical support structure 10. The end portions 34 are further preferably provided with a stepped shoulder portion 36 and a horizontal base portion 38 to enhance the stability and strength of support base structure 24. Cross legs 26 may be formed of any suitable material but are preferably formed from flat bar steel that is ¼ inch in thickness, one inch wide and of a length such that the support base structure 24 will have a diameter of about 14 inches and a height of approximately 8 inches. In the alternative, as best seen in FIG. 4, the stand may be provided with a support base structure 24' formed from cross legs 26' having extended horizontal portions 40 rather than stepped portions, which extended horizontal portions 40 provide the requisite stability for the stand. The cross legs 26' are preferably formed from flat bar steel and have respective dimensions ¼ inch by 1 inch by 18 inches and ¼ inch by 1 inch by 17 inches.

As best seen in FIGS. 1 and 2, one of the support means that may be provided on the vertical support structure comprises a pair of upwardly extending cross arms 42 each provided with a suitable aperture (not shown) midway along its length. Cross arms 42 may be made from any suitable material but are also preferably formed from flat bar steel. The preferred dimensions of each of the cross arms 42 in a pair of cross arms are ¼ inch by 1 inch by 13½ inches and ¼ inch by 1 inch by 14½ inches, respectively. Furthermore, in the preferred embodiment, the upwardly extending portions of cross arms 42 are provided with an outwardly angled portion 43. Cross arms 42 are coupled to vertical support structure 10 at a given vertical interval 20 by inserting male connection end 14 of a collar member 12 through the aperture in each of cross arms 42 and securing it thereto with a suitable nut 44. Cross arms 42 are mounted on male connection end 14 in an angular relation to each other so as to form a generally horizontal support for, for example, a flower pot. Female connection end 16 of another collar member 12 may then be threadingly attached to the exposed end of the inserted male connection end 14 if additional supporting means are to be provided at another, higher, vertical interval 20.

As best seen in FIG. 2, a plurality of pairs of upwardly extend, U-shaped cross arms 42 may be provided along the length of vertical support structure 10. A lowermost pair of U-shaped cross arms 42 may be mounted on the bolt 28 so as to be disposed immediately adjacent support base structure 24.

Figure 6:
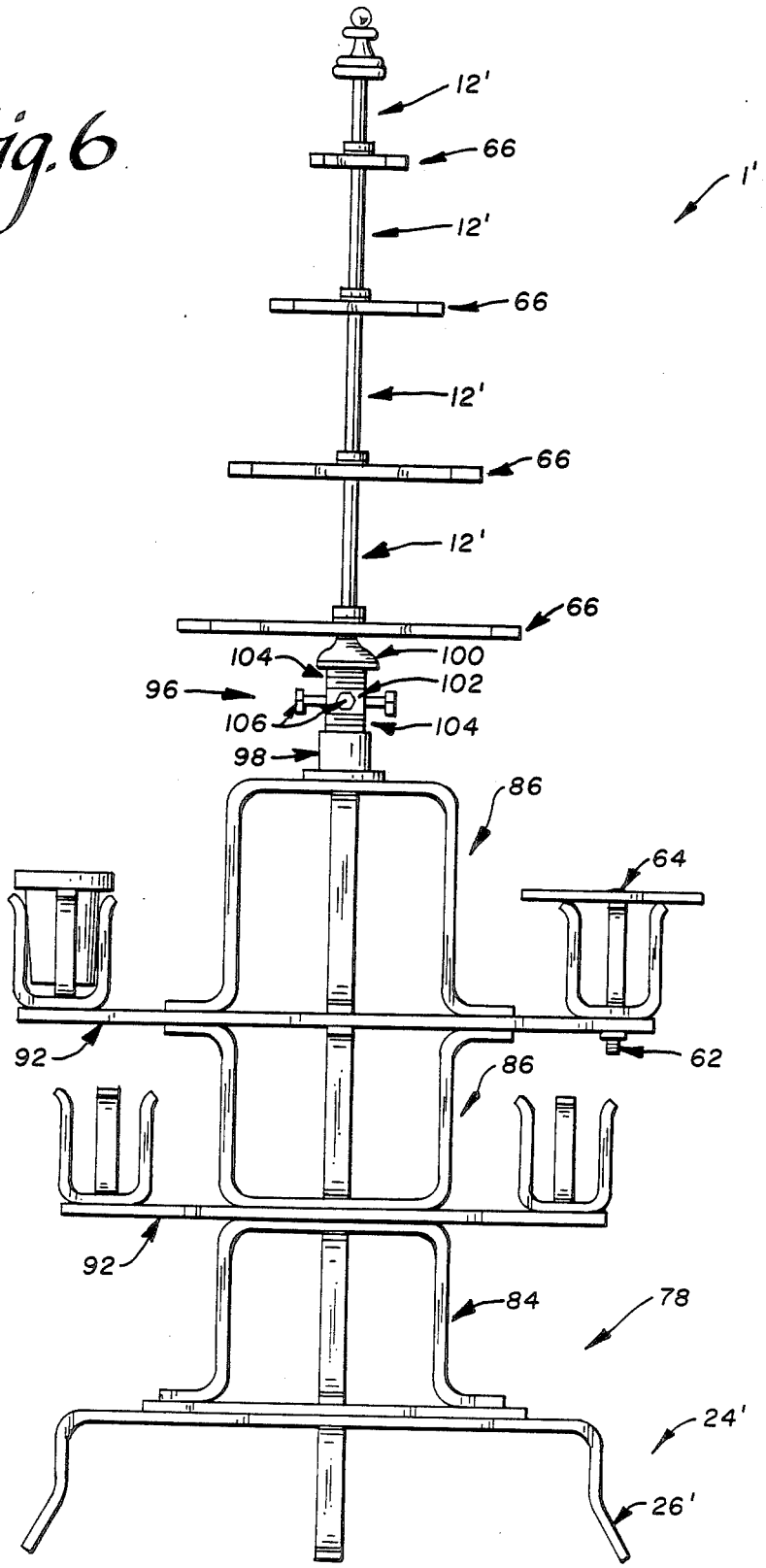
FIG. 6 is a perspective view of an alternative embodiment of the collector stand shown in FIG. 5.

As best seen in FIG. 3, another of the support means that may be provided at one or more of the vertical intervals of the vertical support structure comprises a bar member 46 provided with a suitable aperture 48 midway along its length. In the preferred embodiment bar member 46 is formed from flat bar steel. The bar member 46 is coupled to vertical support structure 10 at a given vertical interval 20 by inserting male connection end 14 of a collar member 12 through aperture 48 in bar member 46. A pair of upwardly extending U-shaped cross arms 50 are provided on at least one end and preferably on both ends of bar member 46. The pair of cross arms 50 is mounted to bar member 46 by inserting a bolt 52 through a suitable aperture 54 provided in bar member 46 and through a suitable aperture 56 provided midway along the length of each of cross arms 50 and by securing the bolt 52 with a nut 58. Cross arms 50 are mounted on the bolt 52 in an angular relation to each other so as to form a generally horizontal support for, for example, a flower pot. In the preferred embodiment, the upwardly extending portion of cross arms 50 are provided with an outwardly angled portion 59. In addition, one or more of the pairs of cross arms 50 may be provided with a planar table top member 60. While table top member 60 may be formed from any suitable material, in the preferred embodiment, it is formed from wood. Table top member 60 may be secured to bar member 46 and cross arms 50 by an elongated bolt 62, passed through a suitable aperture 64 as shown in FIG. 6. In the preferred embodiment, two of the afore described bar members 46 are provided at a given vertical interval 20 and are disposed in an angular relation to one another so as to form a generally horizontal support means.

A plurality of pairs of bar members 46 may be provided along the length of the vertical support structure 10. A lowermost pair of bar members 46 may be mounted on the bolt 28 so as to be disposed immediately adjacent support base structure 24.

Preferably, if more than one pair of bar members 46 are provided along vertical support structure 10, the bar members of each sequentially higher pair are formed with sequentially reduced lengths so as to facilitate the viewing of and access to objects supported on each of the support means.

As best seen in FIG. 4, yet another support means that may be provided at one or more of the vertical intervals of the vertical support structure comprises a planar member 66, preferably rectilinear in shape. Planar member 66 is provided with a suitable aperture (not shown) at the center thereof to enable mounting on a collar member 12' in the manner described with reference to FIGS. 1 through 3. While planar member or members 66 may be formed from any suitable material, in the preferred embodiment the planar members are formed from wood. As was described with reference to FIG. 3, preferably, if more than one planar member 66 are provided along vertical support structure 10', the planar member at each sequentially higher vertical interval is formed with sequentially reduced horizontal dimensions so as to facilitate the viewing of and access to objects supported on each of the support means.

Furthermore, while one or more planar members 66 may be mounted on one or more collar members 12 as was described with reference to FIGS. 1 and 2, it can be seen that since the planar member support means 66 occupies a lesser vertical space than the support means of FIGS. 2 or 3, it may be spaced from support means provided thereabove by a collar member 12' of lesser length than those of FIGS. 1 and 2. In the preferred embodiment, collar member 12' is approximately 5½ inches in length with a male connection end that is ½ inch in diameter and 2 inches long and a female connection end with an internal diameter of ½ inch and a depth of 1 inch. Furthermore, the collar member 12' is preferably formed from steel though it may be formed from any suitable material.

As shown in FIG. 4, a decorative top piece element 68 may be provided above the highest support means of the collector's stand. Top piece element 68 having, for example, a threaded male portion (not shown) at the lower end thereof, may be coupled to the vertical support structure with a connector member 70 having a threaded female portion at the upper and lower ends thereof for threaded connection to the top piece male portion and the male connection end (not shown) of the uppermost collar member 12'. Alternatively, a top piece element 68 having a threaded female portion (not shown) at the lower end thereof may be threadingly attached directly to the male connection end of the upper most collar member 12'.

Additional strength and stability for a planar member support means 66 provided at the second vertical interval 20 may be provided, as shown in FIG. 4, by positioning a cross arm support means 72 (as described with reference to FIGS. 1 and 2) at the lowermost vertical interval 22. Furthermore, a plate member 74 formed of steel, for example, may be provided at the second vertical interval 20, immediately below planar member 66 and similarly mounted on collar member 12'.

Figure 5:
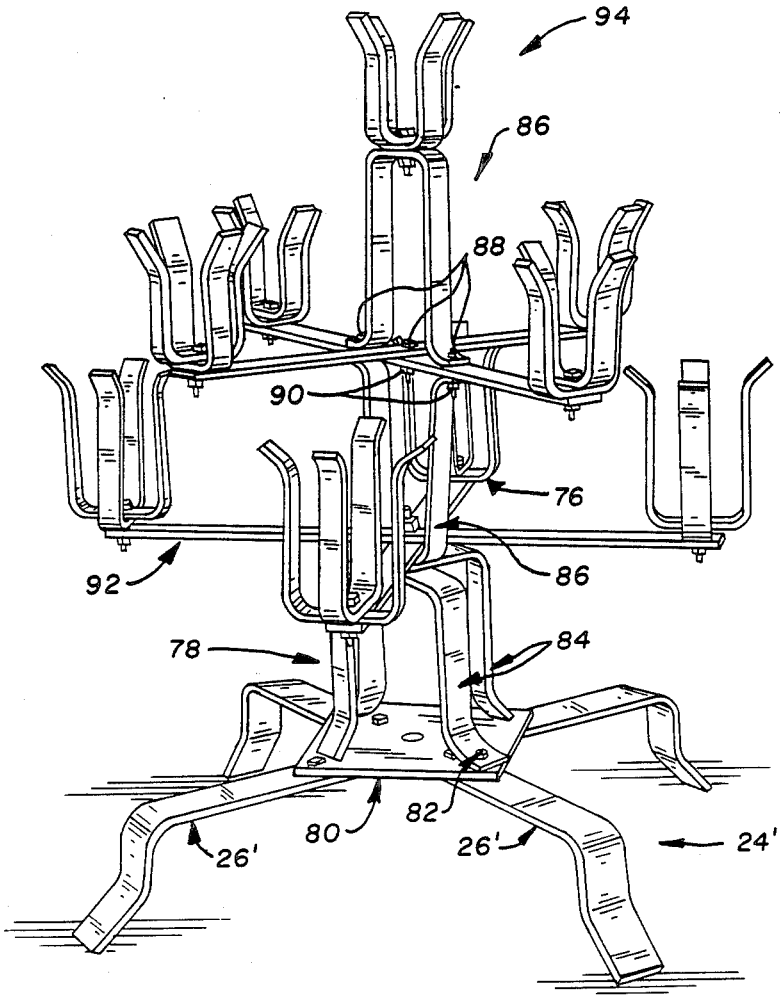
FIG. 5 is an elevational side view of yet another possible combination of vertically spaced support means, provided on an alternative vertical support structure.

FIG. 5 illustrates another collectors stand formed in accordance with the present invention but with an alternate vertical support structure 76. In the illustrated embodiment, the base of the vertical support structure is provided with an inverted cross arm assembly 78

(formed in accordance with the cross arm assembly of FIGS. 1 and 2). Cross arm assembly 78 is mounted to a plate member 80 and to the horizontal base structure 24' with bolts 82 passed through appropriate apertures (not shown) formed in the cross leg elements 26', plate member 80, and cross arms 84 and secured with nuts (not shown). Vertical support structure 76, itself, is formed from alternating upwardly facing and downwardly facing U-shaped elements 86. The alternating U-shaped elements 86 are coupled to one another with bolts 88 which fit through apertures (not shown) in the bases and arms thereof and are secured thereto with appropriate nuts 90. The points of attachment of the alternating U-shaped elements 86 provide the spaced vertical intervals of the collector stand where, for example, a pair of bar members 92 secured to each other midway along their length, may be attached with the bolts 88 passed through appropriate apertures (not shown) formed therein.

The uppermost portion of the vertical support structure 76 may be provided with a cross arm supporting means 94, secured to the uppermost U-shaped member 86 as shown in FIG. 5. In the alternative, a second vertical support structure 10' of the type shown in FIG. 4 may be coupled to the uppermost U-shaped member 86, as shown in FIG. 6. The second vertical support structure 10' may be secured to the uppermost U-shaped member 86 with, for example, an adapter 96 of the type shown in FIGS. 6 and 7. The adapter 96 comprises a cap element 98 which may be secured to the U-shaped element 86 with a bolt and nut (not shown), a bell member 100 adapted to surround the lowermost portion (not shown) of the second vertical support structure 10', a nipple element 102 having threaded male end portions 104 adapted to be threadingly attached to the cap element 98 and the bell member 100, respectively, and a plurality of bolts 106 which pass through appropriate aperture in the nipple element 102 to secure the lowermost portion of the second vertical support structure 10' within the nipple element 102.

Other modifications and variations of the collector's stand of the present invention and of devices embodying the same will become apparent to those skilled in the art from an examination of the above specification and drawings. Accordingly, other modifications and variations of the present invention may be made which fall within the scope of the appended claims even though such modifications and variations were not specifically discussed above.

I claim:

1. A stand for supporting a plurality of objects at a plurality of spaced vertical intervals, said stand comprising:

at least one support means for supporting objects;

a vertical support member on which said at least one support means is removable mounted;

a support base member coupled to said vertical support member for supporting said vertical support member in a vertical manner;

said vertical support member comprising a plurality of alternately upwardly facing and downwardly facing U-shaped elements, coupled at the respective arms and bases thereof, said support means being adapted to be mounted intermediate said couplings, the lowermost U-shaped element being mounted on an inverted pair of U-shaped cross arm elements, said cross arm elements being mounted in angular relation to each other, and said support base member being provided with a plate member to which the lower end of the inverted pair of U-shaped cross arm elements are coupled; and said support base member comprising a pair of cross leg members, said cross leg members being coupled in angled relation midway along their length.

2. The stand of claim 1, comprising at least two support means, at least one of said support means comprising a pair of U-shaped cross arm members, mounted in angled relation to each other.

3. The stand of claim 2, wherein at least one of said support means comprises a bar member and a pair of upwardly extending U-shaped cross arm members mounted in angular relation to each other on each end of said bar member.

4. The stand of claim 3, wherein at least one of said support means comprises a pair of said bar members, mounted in angular relation to each other.

5. A stand of claim 4, wherein there are three support means, one of said support means comprising said pair of U-shaped cross arm members, said one support means being mounted on the uppermost U-shaped element of said vertical support member, and two of said supporting means each comprising a said pair of bar members, said two support means each being adapted to be mounted intermediate one of said couplings.

6. The stand of claim 1, comprising at least two support means, at least one of said support means comprising a bar member and a pair of upwardly extending U-shaped arm elements mounted in angular relation to each other on each end of said bar member.

7. The stand of claim 6, wherein at least one of said support means comprises a pair of said bar members, mounted in angular relation to each other.

8. The stand of claim 7, wherein two of said support means each comprise a pair of said bar members, and further comprising:

a second vertical support member, said second vertical support member comprising a plurality of collar members each having a male end portion and a female end portion, the respective male and female end portions of said collar members being coupled together so that said collar members are coupled end to end in a vertical manner, and a plurality of planar support means, each said planar support means being adapted to be mounted on the male end portion of each said collar member, respectively, at said collar member couplings.

* * * * *